United States Patent [19]

Klaus et al.

[11] 3,978,908

[45] Sept. 7, 1976

[54] METHOD OF DIE CASTING METALS

[75] Inventors: Elmer E. Klaus, State College; Chun W. Lai, Wescosville, both of Pa.

[73] Assignee: Research Corporation, New York, N.Y.

[22] Filed: Jan. 6, 1975

[21] Appl. No.: 538,568

[52] U.S. Cl. ..... 164/72; 427/133; 164/130; 164/138

[51] Int. Cl.[2] ..... B22D 17/20; B22C 3/00

[58] Field of Search ..... 164/72, 73, 74, 138, 164/130; 427/133, 134, 135

[56] References Cited

UNITED STATES PATENTS

| | | | |
|---|---|---|---|
| 2,376,518 | 5/1945 | Spence | 164/73 X |
| 2,923,041 | 2/1960 | Rysnar | 164/72 |
| 2,994,297 | 8/1961 | Toulmin, Jr. | 427/133 X |
| 3,284,862 | 11/1966 | Schweikert | 427/133 X |
| 3,407,865 | 10/1968 | Hammerton | 427/135 X |
| 3,498,359 | 3/1970 | Dunlop | 427/134 X |
| 3,540,514 | 11/1970 | Hammerton | 164/72 X |
| 3,645,319 | 2/1972 | Pondelicek et al. | 164/72 |
| 3,779,305 | 12/1973 | Pondelicek et al. | 164/72 X |

*Primary Examiner*—Ronald J. Shore
*Attorney, Agent, or Firm*—Cooper, Dunham, Clark, Griffin & Moran

[57] ABSTRACT

Molten metal is mold or die cast by contacting the molten metal-contacting surface of the mold or die with a die lubricant or parting agent in the vapor form and in the substantial absence of added liquid lubricant or parting agent prior to introducing the molten metal into contact with the mold or die surface. The contacting of the molten metal-contacting surface of the mold or die with the vaporous lubricant or parting agent is carried out under conditions such that the vaporous lubricant or parting agent applied to or contacting the molten metal-contacting surface of the mold or die undergoes thermal decomposition thereon. The mold or die surface may be a metal or graphite surface and the applied vaporous lubricant or parting agent may be a normally liquid, thermally decomposable organic compound, such as an alkyl phosphate or an aryl phosphate, e.g., tributyl phosphate and tricresyl phosphate.

39 Claims, 3 Drawing Figures

METHOD OF DIE CASTING METALS

Figure 1:
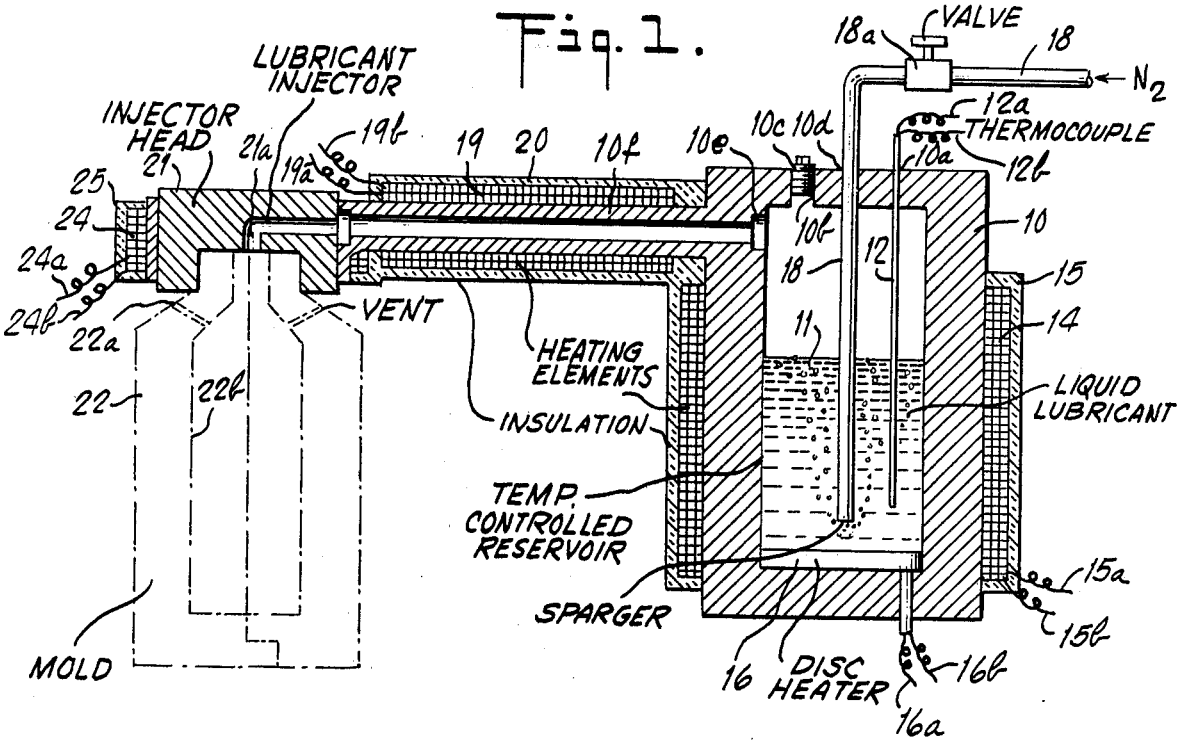

This invention relates to the die or mold casting of molten metal. Mold or die casting of molten metal requires a lubricant or parting agent to provide a thin, uniform, easily sheared film between the die surface and the metal casting. It has been conventional practice to apply a liquid lubricant or parting agent to the die or mold surface before casting. Various techniques and apparatus have been employed heretofore in the mold or die casting of molten metal, but for the most part these techniques and apparatus have not been completely satisfactory, see particularly U.S. Pat. Nos. 865,562, 1,420,888, 2,206,888, 2,831,782, 3,342,249 and U.S. Pat. No. Re 25,424. The disclosures of these patents are herein incorporated and made part of this disclosure.

It is conventional practice, as may be evidenced by the disclosures of the above-identified patents, in metal die casting to apply liquid lubricants to the mold surface. The application of liquid lubricant to the mold surface affects the surface temperature of the mold surface. Typical lubricants employed heretofore have been hydrocarbons (mineral oils or petroleum fractions), water-in-oil emulsions and oil-in-water emulsions. It has also been conventional practice to apply these liquid lubricants in relatively large quantities. As a result, mold lubricants have created problems involving air pollution and fire hazards, particularly due to the large volume of flammable lubricants, such as hydrocarbons, vaporized from the hot mold or die surfaces when the liquid lubricants are applied thereto. Additionally, the use of a liquid lubricant in the die or mold casting of molten metal shock-cools the die surface thereby contributing to thermal fatigue of the die surface.

It is an object of this invention to provide an improved method for die or mold casting of molten metal.

It is another object of this invention to provide an apparatus useful for lubricating the metal-contacting surface of a mold or a die employed for metal casting.

It is another object of this invention to provide a mold having an improved surface useful for the casting of molten metal.

Figure 2:
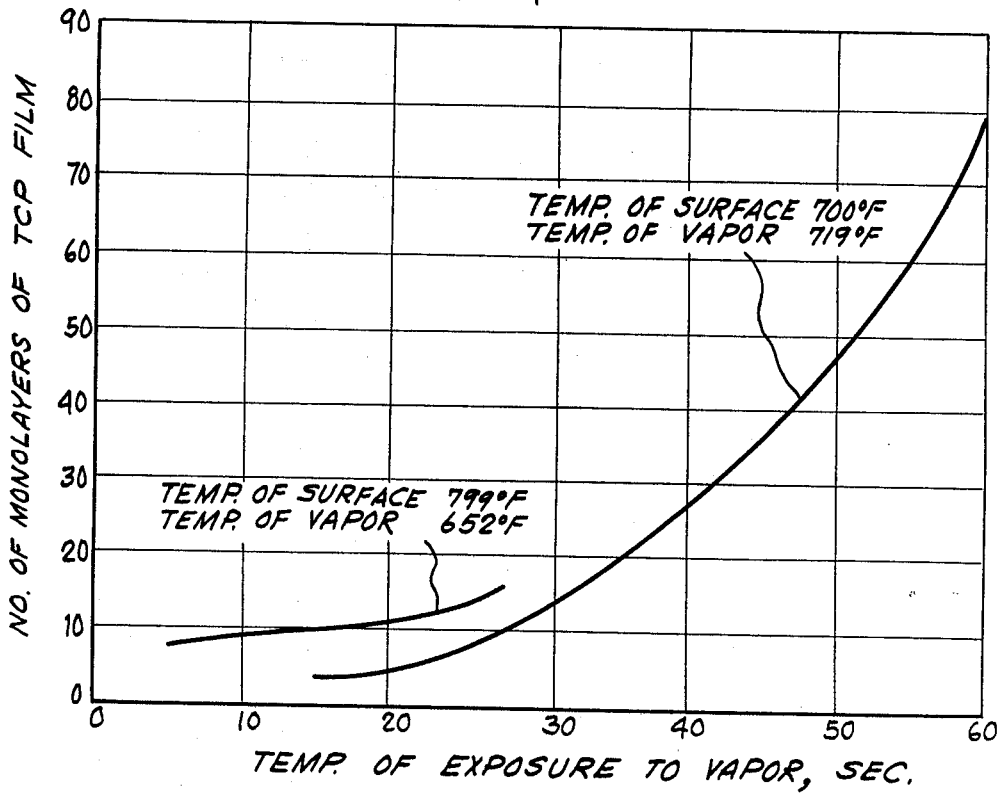
Figure 3:
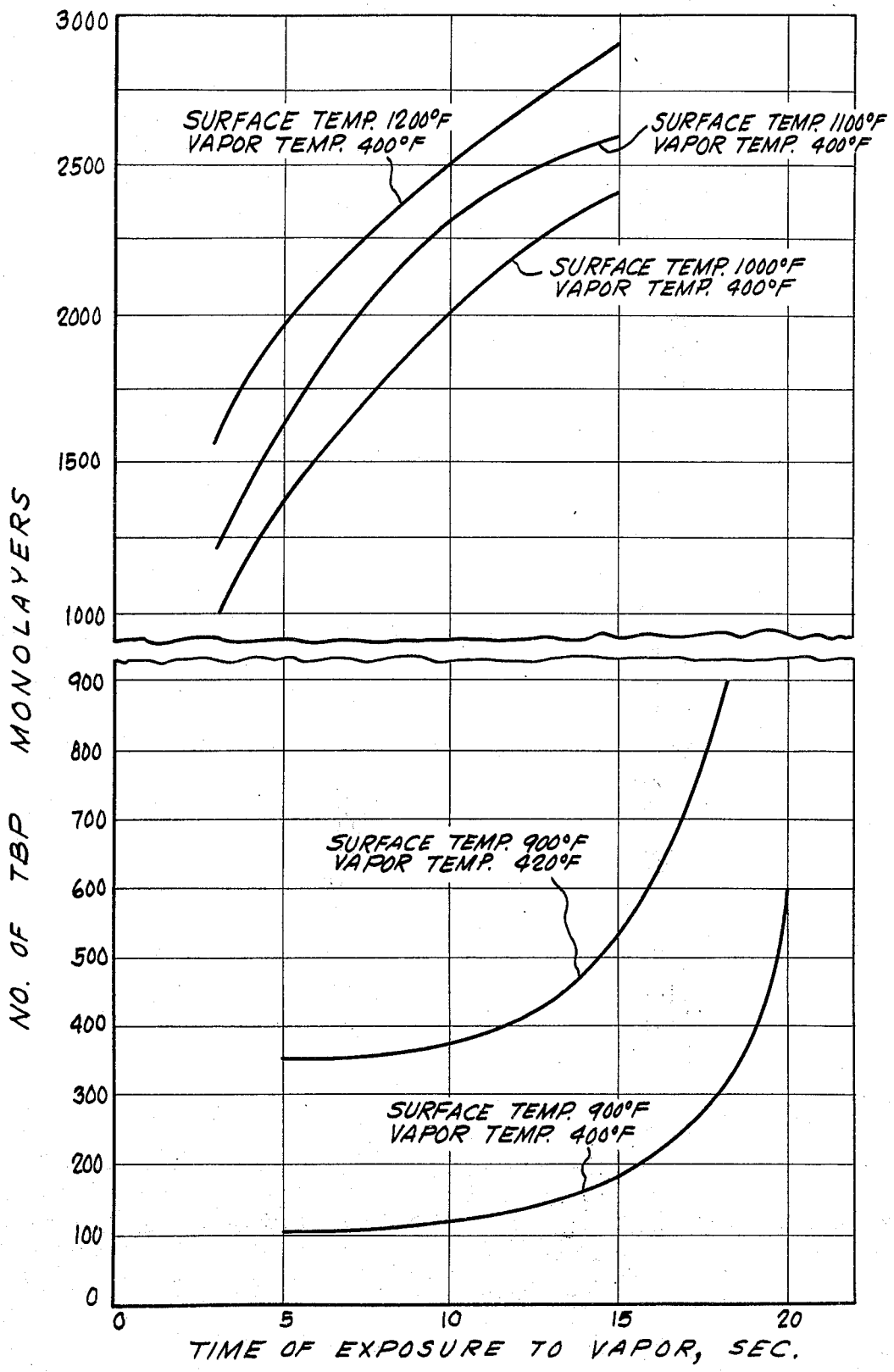

How these and other objects of this invention are achieved will become apparent in the light of the accompanying disclosures made with reference to the drawing wherein:

FIG. 1 schematically illustrates in cross-section an apparatus in accordance with this invention for lubricating the molten metal-contacting surface of a mold or die, and wherein;

FIGS. 2 and 3 graphically represent the influence of temperature and time upon the thickness of a deposited lubricant layer onto the surface of a mold or die in accordance with this invention.

In at least one embodiment of the practice of this invention, at least one of the foregoing objects will be achieved.

In accordance with this invention, the molten metal-contacting surface of a mold or die used for casting of molten metal is contacted with a lubricant or parting agent in a vapor form. More specifically, in accordance with the practices of this invention, the surface of the mold or die is treated with a lubricant or parting agent in vapor or gaseous form, i.e., in a homogeneous gas phase, prior to bringing the resulting treated mold or die surface into contact with the molten metal. The vaporous lubricant or parting agent is applied to the mold or die surface under conditions such that the applied lubricant or parting agent undergoes thermal decompostion thereon.

By introducing the lubricant or parting agent in vapor or gaseous form into contact with the molten metal-contacting mold or die surface, shock-cooling of the surface is avoided. As an ancillary benefit, the cooling rate of the die or mold can be controlled to minimize thermal fatigue. Since the mold or die surface is treated by contact with the lubricant or parting agent in gaseous or vapor form, desirably in the presence of an inert carrier gas, such as carbon dioxide, nitrogen, helium or argon, or other suitable inert gas, and desirably in the absence of liquid lubricant or parting agent, fire hazards and problems of air pollution, hereteofore experienced when a liquid lubricant was applied to a hot mold surface, are reduced or avoided.

Desirably, the vapor form or gaseous form lubricant, in the substantial absence of a liquid lubricant, is applied to the usually hot die surface with the die disclosed and prior to the actual casting operation, thereby limiting the path of any excess vaporized lubricant to the vents in the die. By applying the lubricant in this manner, the ventilation requirements for a safe work space are minimized. In another type of metal casting, wherein an open die is immersed in a pool of molten metal and the die closed and withdrawn with molten metal retained therein, the entire die surface, outside and inside, which would come into contact with the molten metal would be treated with the vaporized lubricant or parting agent in accordance with this invention.

The practice of this invention is particularly applicable to the mold or die casting of high melting point metals, alloys and specialty steels, such as stainless steel. Generally, however, the practice of this invention is applicable to the die or mold casting of metals, including steel, aluminum and aluminum alloys, magnesium and magnesium alloys, zinc and zinc alloys, bronze alloys, copper alloys and other die castable metals and alloys, such as molybdenum alloys and chromium alloys.

The techniques and resulting advantages of this invention involving the vapor phase lubrication of die or mold surfaces are applicable and are realizable in the conventional apparatus employed in the mold and die casting of die castable metals. The advantages of this invention, however, are particularly apparent in connection with the lubrication of graphite mold surfaces, such as mold surfaces made of Carbitex 700, PO3N and AZ-4009 graphite manufactured by Carborundum Company and especially in connection with mold surfaces employed for the casting of high melting point metals, particularly stainless steel and the like.

Various, even conventional, mold lubricants are usefully employed in the practices of this invention, provided, of course, as required by the practices of this invention, the lubricant is applied to the molten metal-contacting mold surface in vapor or gaseous form and in the substantial absence of added liquiform or liquid lubricant. Suitable lubricants in the practices of this invention include the organic compounds, such as esters of mono- and polybasic acids, such as the phosphorus acids, e.g., phosphoric acid, including mono- and polycarboxylic acids, the polyol esters of monobasic acids, the polyesters, the silicate esters, the silicones, polyolefins and the borate esters, and combinations thereof. Organo-metallic compounds are useful and, in some instances, are preferred in the practices of this invention. Particularly useful in the practices of this invention are the organophosphorus compounds, such as the alkyl phosphates, the aryl phosphates, the alkaryl phosphates, the aralkyl phosphates, the mixed alkyl aryl phosphates, the alkyl phosphites, the aryl phosphites, the alkaryl phosphites, the aralkyl phosphites, the mixed alkyl aryl phosphites and also the above-mentioned corresponding phosphonates and the other phosphorus-containing organic compounds. Especially useful are the lower molecular weight $C_1$–$C_7$ trialkyl phosphates, such as tributyl phosphate, and the $C_6$–$C_{18}$ triaryl phosphates, such as tricresyl phosphate, and derivatives thereof.

It is preferred in the practices of this invention to employ as the lubricant an organic compound, such as an ester, or one of the aforementioned organophosphorus compounds which thermally decompose at a temperature above about 400°F., preferably above 600°F., such as a temperature in the range 700°–1200°F.

It is preferred in the practices of this invention that the vapor form or vaporized lubricant when applied to the mold surface be at a fairly high temperature, that is, the vapor be applied at the highest practical temperature in order to maximize the vapor pressure of the applied lubricant without undue deterioration or decomposition of the lubricant during vaporization and prior to contact with the mold or die surface. Since many useful lubricants are organic compounds which decompose at or about their atmospheric boiling point, the vaporized organic lubricants ae usually applied at temperatures below their boiling point, e.g., tributyl phosphate (b.p. about 560°F.) at a temperature of about 400°F. and tricresyl phosphate (b.p. about 790°F.) at a temperature of about 650°F. It is particularly preferred in the practices of this invention that the vapor form or vaporized lubricant be applied to the surface of the mold wherein the initial temperature of the mold surface on contact with the vaporized lubricant is above 400°F., preferably above 600°F., such as in the range 700°–1200°F., at a temperature and under conditions, such as time of application or exposure, sufficient to effect thermal decomposition of the applied vapor form lubricant in the mold surface.

In one special embodiment of the practices of this invention, vaporized lubricant is applied to the mold surface and maintained in contact therewith under conditions to effect thermal decomposition of the vaporized lubricant on the mold surface. Depending upon the chemical make-up of the lubricant, the vaporized lubricant will thermally decompose on the surface of the mold at varying decomposition temperatures and periods of residence or contact therewith. As mentioned hereinabove, it is preferred to employ a lubricant which thermally decomposes at a temperature above 400°F., preferably above 600°F., such as a temperature in the range from about 650°–700°F. to about 900°–1200°F. The mold surface upon initial contact of the vaporized lubricant is preferably at a temperature of at least 400°F., preferably above 600°F., such as a temperature in the range 900°–1500°F., having in mind that in stainless steel die casting, the mold surface temperature will reach a temperature of about 2900°–3000°F. during the casting operation.

As indicated hereinabove, it is preferred to maintain the vaporized lubricant in contact with the hot mold surface for a substantial period of time, such as a period of time of about 3 seconds to about 60 seconds, more or less. The time the vaporized lubricant is maintained in contact with the mold surface in order to provide an effective lubricating or parting surface or coating thereon depends on various factors including, among others, the temperature of the mold surface, the temperature of the vaporized lubricant, the partial pressure of the vaporized lubricant and the chemical make-up of the lubricant itself and the die or mold surface.

In the practices of this invention, as indicated hereinabove, it is preferred to apply the vaporized lubricant to the mold surface under conditions such that vaporized lubricant is carried to or applied to the mold surface by way of and in the presence of an inert carrier gas, such as nitrogen, carbon dioxide, helium, argon and the like. Depending upon the combination of the aforesaid conditions, various thicknesses of the applied lubricant can be deposited on the mold surface. Partial pressure of the applied vaporized lubricant is preferably above 25–50 mm Hg, such as in the range from about 60–65 to about 250–500 mm Hg, more or less.

The lubricant applied to and deposited on the mold surface may have a thickness in the range from a few, about 5, molecular monolayers of the applied lubricant, such as when the vaporized lubricant is applied to contact the mold surface at a low temperature of about 400°F. and maintained in contact therewith for a short period of time of a few seconds, e.g. 3, up to a thickness of about hundreds and even a few thousand, such as 3000, molecular monolayers as when the applied vaporized lubricant at a high partial pressure is maintained in contact with the mold surface for an extended period of time of about 15 seconds, even up to 60 seconds and more, and the temperature of the mold surface is greater than 700°F., such as about 1200°F. Under such conditions, having in mind that a molecular monolayer of tricresyl phosphate has a thickness estimated at about $1 \times 10^{-7}$ cm and a molecular monolayer or monomolecular layer of tributyl phosphate has an estimated thickness of about $9.52 \times 10^{-8}$ cm, a substantial thickness of lubricant, measured or calculated as molecular monolayers of the applied lubricant, can be built up upon a mold surface. When organophosphorus compounds are employed as lubricants and when the surface temperature of the mold is above the decomposition temperature of the applied lubricant, there would be produced a phosphorus-rich or phosphorus-containing coating (the resulting thermal decomposition products) on the mold surface which would serve as the actual lubricant or parting agent for the release of solidified cast metal from the mold.

Reference is now made to the drawings, particularly FIG. 1 thereof, which schematically illustrates in cross-section, apparatus useful for carrying out the practices of this invention. As illustrated in FIG. 1, container 10 is provided with pool or body 11 of liquid lubricant, such as tributyl phosphate or tricresyl phosphate. Thermocouple probe 12 is inserted through opening **10*a* in container 10 to determine the temperature of body 11 of lubricant by measuring the voltage differential across thermocouple wires 12*a* and 12*b*. Container 10 is also provided with electrical heating element 14 supplied with electricity by electrical leads 15*a* and 15*b* and whch is covered by a suitable insulation 15**.

Opening **10*b* is provided in the top of container 10 for adding liquid lubricant thereto. Opening 10*b* is closed, as illustrated, with screw cap 10*c*. Container 10** is also closed, as illustrated, with screw cap 10*c*. Container 10 is also provided in the body thereof with electrical disc heater 16 for heating the liquid lubricant therein, the electrical energy required to operate heater 16 being supplied via electrical leads 16*a* and 16*b*. Associated with container 10 is pipe 18 for the supply of inert gas, such as nitrogen. Pipe 18 is provided with valve 18*a* and enters container 10 through opening 10*d* in the top thereof and supplies inert gas, such as nitrogen, to the bottom of container 10 and the lower portion of body 11 of lubricant thereof.

With gaseous nitrogen, from a suitable source not shown, flowing through pipe 18 into the bottom of heated body 11 of liquid lubricant, the body of liquid lubricant being maintained at a high temperature, usually the highest practical without undue deterioration or decomposition of the liquid lubricant within container 10, there issues from container 10 via outlet 10*e* and container outlet pipe 10*f* a substantially liquid-free mixture containing the vaporized lubricant and gaseous nitrogen. As illustrated, outlet container pipe 10*f* is heated by suitable electrical heating means 19 provided with electrical leads 19*a* and 19*b*, the electrical heating means 19 beng covered with insulation 20.

The mixture of gaseous nitrogen and vaporized lubricant exits from outlet container pipe 19 into injector head 21 via passageway 21*a* therein for introduction into mold 22, shown in dashed outline. Mold 22 is provided with vents 22*a* and, as illustrated, in closed so that the mixture of nitrogen and vaporized lubricant enters mold 22 and the gaseous effluent, nitrogen, entering mold 22 leaves via vents 22*a*. Injector head 21, as illustrated, is heated by means of suitable electrical heating means 24 provided with electrical heating leads 24*a* and 24*b*, electrical heating means being covered by insulation 25. By heating outlet container pipe 10*f* and injector head 21, it is assured that the vaporized lubricant leaving container 10 via outlet container pipe 10*f* is maintained vaporized throughout its travel therethrough into mold 22.

By use of the illustrated apparatus, mold 22 is supplied with vaporized lubricant. Depending upon the time and temperature of contact of the vaporized lubricant with the mold surface, the chemical composition of the lubricant and the partial pressure of the vaporized lubricant, one can build up a coating of thermally decomposed lubricant on mold surface 22*b* to the desired thickness.

Illustrative of the extent to which a coating of lubricant can be deposited upon a mold surface, graphite pieces of Carbitex 700 and AZ-4009 graphite manufactured by Carborundum, which provides surfaces typical of actual die or mold surfaces, were exposed to vaporized tricresyl phosphate (TCP) and tributyl phosphate (TBP) for varying periods of time and at varying temperatures. In these tests, the graphite samples and the lubricant (TCP or TBP) were separately heated to the desired temperatures, each in a nitrogen atmosphere. When steady state conditions were obtained, a stream of nitrogen was then allowed to carry the vaporized lubricant into contact with the graphite piece for a predetermined period of time for deposition and thermal decomposition of the vaporized lubricant thereon. The resulting treated graphite samples were then removed and subjected to activated analysis to determined the amount of phosphorus, thereby indicating the quantity and thickness of the lubricant film deposite thereon. Other tests similar to the above were carried out involving the deposition and thermal decomposition of vaporized tricresyl phosphate on a stainless steel surface and the deposition and thermal decomposition of vaporized tributyl phosphate on WN-102 tungsten, stainless steel, aluminum, chromel and alumel surfaces.

Table I sets forth the results of these tests employing TCP as the lubricant for deposition and thermal decomposition upon the Carbitex 700 graphite surfaces.

TABLE I

Thickness of TCP Film Deposited on Carbitex 700

| Temp. of Sample, °F. | Temp. of TCP Vapor, °F. | Time of Exposure to Vapor, Sec. | Thickness of TCP Film, No. of Monolayers |
|---|---|---|---|
| 700 | 719 | 15 | 4 |
| 700 | 719 | 20 | 5 |
| 700 | 719 | 25 | 8 |
| 700 | 719 | 60 | 79 |
| 799 | 652 | 5 | 7 |
| 799 | 652 | 10 | 8 |
| 799 | 652 | 20 | 14 |
| 799 | 652 | 30 | 19 |

The results of these tests are plotted in graphic form in accompanying FIG. 2 of the drawings.

Tables II and III show the results of these tests employing TBP as the lubricant for deposition on Carbitex 700 and AZ-4009 graphite surfaces.

TABLE II

Thickness of TBP Film Deposited on Carbitex 700

| Temp. of Sample °F. | Temp. of TBP Vapor °F. | Time of Exposure to Vapor, Sec. | Thickness of TBP Film, No. of Monolayers |
|---|---|---|---|
| 900 | 400 | 5 | 107 |
| 900 | 400 | 10 | 118 |
| 900 | 400 | 15 | 177 |
| 900 | 400 | 20 | 580 |
| 900 | 420 | 5 | 351 |
| 900 | 420 | 10 | 369 |
| 900 | 420 | 15 | 528 |
| 900 | 420 | 20 | 2123 |

TABLE III

Thickness of TBP Film on AZ-4009 Graphite

| Temp. of Sample °F. | Temp. of TBP Vapor °F. | Time of Exposure to Vapor, Sec. | No. of Monolayers of TBP Film |
|---|---|---|---|
| 1000 | 400 | 3 | 1017 |
| 1000 | 400 | 5 | 1477 |
| 1000 | 400 | 10 | 1920 |
| 1000 | 400 | 15 | 2384 |
| 1100 | 400 | 3 | 1204 |
| 1100 | 400 | 5 | 1605 |
| 1100 | 400 | 10 | 2278 |
| 1100 | 400 | 15 | 2624 |
| 1200 | 400 | 3 | 1536 |
| 1200 | 400 | 5 | 1966 |
| 1200 | 400 | 10 | 2452 |
| 1200 | 400 | 15 | 2904 |

The data of Tables II and III are graphically illustrated in accompanying FIG. 3 of the drawings.

Tributyl phosphate boils at 558°F. at atmospheric pressure and tricresyl phosphate boils at 788°F. at atmospheric pressure. The data of Tables I–III and graphically presented in FIG. 2 and FIG. 3 show that the thickness of the deposited film of TBP and TCP is sensitive to the time of exposure, temperature or vapor pressure of the vaporized TBP or TCP and the temperature of the graphite surface being coated. The increased film thickness of TBP reflects the increased thermal stability of the aryl phosphates, such as TCP, over the alkyl phosphates, such as TBP. It is pointed out that the thickness of a monomolecular layer of TCP is about $1 \times 10^{-7}$ cm and the thickness of a monomolecular film of TBP is about $9.52 \times 10^{-8}$ cm. The neutron activation analyses employed in the analyses of the deposited coatings indicated the amount of phosphorus in the coating and the amount of measured phosphorus was calculated into corresponding monomolecular layers of the applied lubricant, TCP or TBP.

Since TBP is thermally decomposed at a lower temperature than TCP, a graphite (PO3N graphite manufactured by Carborundum Company) mold surface was treated in accordance with this invention by exposure to vaporized TBP. The resulting treated mold was then employed for the production of stainless steel castings. The results of these tests employing a TBP coated mold for stainless steel castings were completely satisfactory.

In the disclosure of this invention, as indicated herein, the terms "lubricant" and "parting agent" have been used synonymously. In the selection of the lubricant or parting agent to be applied in vapor form to the molten metal-contacting surface of the die or mold, whether interior or exterior, the lubricant or parting agent is selected so as to provide, when applied to the molten metal-contacting surface, a coating thereon so as to provide quick release or removal of the cast metal, especially after solidification, from the die or mold surface in contact therewith. It would appear the quick release of the solidified cast metal from the treated mold or die surface, in accordance with this invention, is effected, as indicated hereinabove, by a breaking away from the treated surface of a very thin film of the applied lubricant or parting agent. In a sense, the applied lubricant or parting agent provides an ablative coating, a thin film thereof of substantially molecular dimension, which coating is at least partially removed or destroyed when the solidified cast metal is taken from the mold and is desirably renewed or replaced by contact with additional vapor form lubricant or parting agent prior to the next, subsequent casting, all in accordance with the invention as disclosed herein.

In the practices of this invention, as indicated hereinabove, it is preferred to employ phosphate esters, particularly the alkyl and aryl phosphate esters, such as the trialkyl phosphate esters wherein the alkyl group is in the range $C_1$–$C_6$, e.g. tributyl phosphate, and the triaryl phosphates wherein the aryl group is in the range $C_6$–$C_{20}$, e.g. tricresyl phosphate. Other organic compounds which have been found useful in the practices of this invention, as indicated hereinabove, include the esters of carboxylic acids, such as the dibasic acid esters of adipic, azelaic and sebacic acid, such as di-2-ethylhexyl sebacete, trimethylol propane and triheptanoate.

Materials which are useful in the manufacture of molds for metal die casting and which are usefully treated in accordance with this invention include, as indicated hereinabove, graphite, tungsten, aluminum, stainless steel, alumel and chromel. In effect, however, substantially any substrate or material useful in the manufacture of metal die casting molds are usefully treated in accordance with this invention for the application thereon of an ablative-type coating of lubricant or parting agent. The thickness of the deposited coating in accordance with the practices of this invention may vary from about 10 molecular monolayers of the thickness of the applied lubricant up to about 5000 molecular monolayers of the applied lubricant, such as an actual coating thickness in the range from about a fraction of a micron, such as from about 0.005–0.01 micron, more or less, to about 10–50 microns, more or less.

In the die casting operation employing a mold treated in accordance with the practices of this invention, the mold surface to which the vaporized lubricant is applied will be exposed to a wide range of temperatures depending upon the molten metal being cast. For example, in the die casting of molten stainless steel, the surface of the mold will usually undergo a cyclic temperature range of about 1000°F., in the die casting of aluminum brass, the cyclic temperature range of the mold surface would be about 500–600°F. and in the die casting of zinc or high zinc alloys, the cyclic temperature range would be about 200°F. It is seen therefore that by employing the practices of this invention, shock-chilling and thermal fatigue of the mold surface is substantially reduced or eliminated as compared with the conventional die casting operation wherein the die surface has applied thereto the lubricant in liquid form and in large amounts sufficient to shock-cool the mold surface.

In the practices of this inention, it is preferred that the mold surface which is exposed to the vapor-form or vaporous lubricant or parting agent for the build-up on the mold surface by thermal decomposition of a coating be at a temperature of at least in the range about 600°–800°F., preferably not greater than 1200°–1300°F. It has been observed that when the mold surface to which the vaporous lubricant is applied is at a temperature greater than 1200°F., the amount of coating capable of being built up or formed thereon by thermal decomposition of the applied vaporous lubricant becomes less as compared, under similar conditions, when the mold temperature is less than 1200°F.

Although the practices of this invention have been described as being applicable to die or mold casting of molten metals, the practices of this invention are also applicable to other metal working operations wherein a lubricant during the metal working operation may be required. The practices of this invention provide an excellent technique for the creation of such lubricating surfaces.

Further, as indicated hereinabove, in the practices of this invention there is produced on the metal-contacting surface of a die or mold a coating which promotes the separation of the solidified cast metal from the die or mold surface. During the separation of the solidified cast metal from the die or mold, usually at least some of the coating is removed. The coating produced in accordance with the practices of this invention can be considered an ablative-type coating, i.e., a coating which tends to be destroyed or removed in use during the casting operation. Accordingly, in a multiple or sequential casting operation wherein multiple castings are made from the same die or mold, the coating would be removed.

In order to maintain the coating on the die or mold surfaces coming into contact with the molten metal, it would be desirable and, in some instances, necessary to renew or reform the coating thereon in the interval during the casting operations, sometimes after each casting operation or after a multiple of casting operations. To this end, therefore, the coating between each or a selected number of casting operations would be renewed by exposing the metal-contacting die or mold surface to the vaporized lubricant for thermal decomposition thereon to renew or replenish the coating.

As indicated hereinabove, the lubricant or parting agent coating deposited on the die or mold surface would have the selected and desired thickness necessary to effect satisfactory release of the solidified cast metal from the die or mold, the thickness being in the range of about 0.005 micron, more or less, up to a greater thickness, such as in the range about 50–100 microns, more or less, depending upon the metal being cast, the severity of the casting operation and the difficulty in and the ease desired in separating the solidified cast metal from the mold. When multiple or sequential castings are made, intervening applications of vaporized lubricant to the mold surface may be made in accordance with the practices of this invention, not only to maintain a satisfactory coating thickness for ready removal of the solidified cast metal but also to replenish or redeposit the coating which had been removed or otherwise rendered ineffective by the previous casting operations on the same surface. During these intervening applications of vaporized lubricant for coating renewal, the coating thus produced and laid down on a die or mold surface need not be the same original thickness, such as in the range 0.005–50 microns, more or less, but could be of substantially less thickness, such as a few molecular monolayers of the vaporized lubricant, such as 2–20 molecular monolayers, a thickness substantially less than 1 micron. If, however, because of the severity of the casting operation the previous, deposited coating is destroyed or removed or rendered ineffective, then between each casting operation an intervening coating operation is carried out to deposit on the die or mold surface a sufficient thickness of lubricant to achieve the desired thickness and/or effect a satisfactory release of the solidified cast metal from the mold.

As will be apparent to those skilled in the art in the light of the foregoing disclosure, many modification, alterations and substitutions are possible without departing from the spirit or scope thereof.

We claim:

1. In a casting operation wherein molten metal is introduced a plurality of times into a mold or die for casting the metal thus-introduced into a corresponding number of objects of a desired shape, including the application of a lubricant to the mold or die surface prior to the introduction of molten metal into contact therewith, the improvement which comprises intermittently applying said lubricant as a vapor to said mold or die surface during the casting operation under conditions such that the lubricant undergoes thermal decomposition on said mold or die surface.

2. An operation in accordance with claim 1 wherein said vapor-form lubricant is introduced into contact with said mold or die surface under conditions such that the lubricant thus-introduced undergoes thermal decomposition upon contact with said die surface.

3. An operation in accordance with claim 1 wherein said vapor-form lubricant is introduced into contact with said mold or die surface in the substantial absence of added liquidform lubricant.

4. An operation in accordance with claim 1 wherein at least a portion of the applied vapor-form lubricant condenses on said mold or die surface prior to undergoing thermal decompostion thereon.

5. An operation in accordance with claim 1 wherein the molten metal is stainless steel.

6. An operation in accordance with claim 1 wherein said mold or die surface is a graphite surface.

7. An operation in accordance with claim 1 wherein said lubricant is introduced as a vapor in an inert carrier gas.

8. An operation in accordance with claim 7 wherein said carrier gas is nitrogen.

9. An operation in accordance with claim 7 wherein said carrier gas is carbon dioxide.

10. An operation in accordance with claim 7 wherein said carrier gas is helium.

11. An operation in accordance with claim 7 wherein said carrier gas is argon.

12. An operation in accordance with claim 1 wherein the temperature of said mold or die surface upon initial contact with said lubricant is at a temperature of at least about 600°F.

13. An operation in accordance with claim 12 wherein said mold or die surface is at a temperature in the range 700°–1200°F.

14. An operation in accordance with claim 1 wherein said molten metal is molten stainless steel.

15. An operation in accordance with claim 1 wherein said molten metal is a molten aluminum or aluminum alloy.

16. An operation in accordance with claim 1 wherein said molten metal is molten magnesium or magnesium alloy.

17. An operation in accordance with claim 1 wherein said molten metal is molten steel.

18. An operation in accordance with claim 1 wherein said molten metal is molten copper or copper alloy.

19. An operation in accordance with claim 1 wherein said molten metal is a molten molybdenum alloy.

20. An operation in accordance wth claim 1 wherein said molten metal is a molten chromium alloy.

21. An operation is accordance with claim 1 wherein said lubricant is a normally organic liquid compound which undergoes thermal decomposition at a temperature above about 400°F.

22. An operation in accordance with claim 21 wherein said compound is a normally liquid organic compound having an atmospheric boiling point of at least 400°F.

23. An operation in accordance with claim 21 wherein said normally liquid organic compound is a phosphorus-containing organic compound.

24. An operation in accordance with claim 23 wherein said phosphorus-containing compound is an aryl phosphate.

25. An operation in accordance with clam 23 wherein said phosphorus-containing compound is an alkyl phosphate.

26. An operation in accordance with claim 23 wherein said phosphorus-containing compound is an aryl phosphite.

27. An operation in accordance with claim 23 wherein said phosphorus-containing compound is an alkyl phosphite.

28. An operation in accordance with claim 23 wherein said phosphorus-containing compound is an aryl phosphonate.

29. An operation in accordance with claim 23 wherein said phosphorus-containing compound is an alkyl phosphonate.

30. An operation in accordance with claim 21 wherein said organic compound is an ester of a carboxylic acid.

31. An operation in accordance with claim 30 wherein said carboxylic acid is a monocarboxylic acid.

32. An operation in accordance with claim 30 wherein said carboxylic acid is a polycarboxylic acid.

33. An operation in accordance with claim 22 wherein said liquid organic compound is a metallo-organic compound.

34. An operation in accordance with claim 22 wherein said liquid organic compound is a silicate ester.

35. An operation in accordance with claim 22 wherein said liquid organic compound is a borate ester.

36. An operation in accordance with claim 1 wherein said lubricant is maintained in contact with said mold or die surface for a period of time within the range from about 3 seconds to about 60 seconds with the mold or die surface at a temperature in the range 400°–1500°F.

37. An operation in accordance with claim 2 wherein said lubricant introduced is at a temperature greater than 400°F. and is maintained in contact with said mold or die surface at a temperature in the range 700°–1200°F. for a period of time greater than about 3 seconds.

38. An operation in accordance with claim 1 wherein said lubricant is an organosiloxane polymer.

39. An operation in accordance with claim 1 wherein said lubricant is a hydrocarbon.

* * * * *

UNITED STATES PATENT OFFICE
CERTIFICATE OF CORRECTION

PATENT NO. : 3,978,908
DATED : September 7, 1976
INVENTOR(S) : Elmer E. Klaus and Chun W. Lai It is certified that error appears in the above-identified patent and that said Letters Patent are hereby corrected as shown below:

Column 6, line 5, "chromel" and "alumel" should correctly read -- Chromel -- and -- Alumel -- line 6, after "surfaces" insert -- (Chromel and Alumel are trademarks of Hoskins Manufacturing Company for nickel-containing alloys)

Signed and Sealed this
*fifth* Day of *July 1977*

[SEAL]

*Attest:*

RUTH C. MASON
*Attesting Officer*

C. MARSHALL DANN
*Commissioner of Patents and Trademarks*